US006532878B2

(12) United States Patent
Tidemann

(10) Patent No.: US 6,532,878 B2
(45) Date of Patent: Mar. 18, 2003

(54) SLOT-TO-SLOT INTERLOCKING SHELVING

(76) Inventor: W. Scott Tidemann, 2119 Bryant Ave., Colorado Springs, CO (US) 80909

( * ) Notice: Subject to any disclaimer, the term of this patent is extended or adjusted under 35 U.S.C. 154(b) by 14 days.

(21) Appl. No.: 09/870,008

(22) Filed: May 29, 2001

(65) Prior Publication Data

US 2002/0178979 A1 Dec. 5, 2002

(51) Int. Cl.[7] ..... A47B 91/00
(52) U.S. Cl. ..... 108/186; 108/180; 108/158.12
(58) Field of Search ..... 108/180, 186, 108/187, 188, 190, 153.1, 101, 158.12; 211/134, 186, 187

(56) References Cited

U.S. PATENT DOCUMENTS

| | | | | | |
|---|---|---|---|---|---|
| 2,366,677 | A | * | 1/1945 | Rosenthal | 108/180 |
| D161,627 | S | * | 1/1951 | Haworth | |
| 3,069,216 | A | * | 12/1962 | Vaeth | 108/180 |
| 4,022,327 | A | * | 5/1977 | Anderson | 211/186 |
| 4,267,998 | A | * | 5/1981 | Weirich | 108/158.12 |
| 4,345,525 | A | * | 8/1982 | de poorter | 108/180 |
| 4,562,776 | A | * | 1/1986 | Miranda | 108/158.12 |
| 4,832,421 | A | * | 5/1989 | Shoffner | 312/263 |
| 5,855,175 | A | * | 1/1999 | Forbes | 108/180 |
| 6,132,017 | A | * | 10/2000 | Gallegos | 312/140.1 |
| 6,174,116 | B1 | * | 1/2001 | Brand | 410/121 |

FOREIGN PATENT DOCUMENTS

| | | | | |
|---|---|---|---|---|
| GB | 2092884 | * | 8/1982 | 108/180 |
| GB | 2105982 | * | 4/1983 | 108/180 |

* cited by examiner

*Primary Examiner*—Lanna Mai
*Assistant Examiner*—Hanh V. Tran
(74) *Attorney, Agent, or Firm*—Richard W. Hanes; Hanes & Schutz, P.C.

(57) ABSTRACT

A shelving unit that comprises shelves that are interconnected without fasteners to form a free standing piece of furniture, having a base shelf and at least one additional shelf, a plurality of spaced apart elongated mutually parallel slots disposed transversely in the rear edge of each of said shelves intermediate the first and second ends thereof, at least one brace-receiving slot disposed in the rear edge of the base shelf, a plurality of support members, each having front and rear edges, a plurality of elongated mutually parallel slots disposed in the front edge of each of said support members, whereby the slots in the support members are sized and adapted for interlocking engagement with corresponding slots in the shelves, at least one brace-receiving slot in the rear edge of each of said support members and at least one brace member having ends that are respectively adapted to be disposed in the brace-receiving slot of the base shelf and the support member.

8 Claims, 4 Drawing Sheets

SLOT-TO-SLOT INTERLOCKING SHELVING

The present invention relates primarily to shelving and in particular to that type of shelving where the horizontal shelves and the vertical support members are fastened together with interlocking slot-to-slot connections.

BACKGROUND

It is well known in the prior art to angularly interconnect planar members with interlocking slots in both of the members. This technique has been applied in the fabrication of honeycomb structures and in assembling shelving and furniture, to cite only a few examples. In the later case, U.S. Pat. No. 5,855,175 to Peter B. Forbes for Shelving For CDs and Cassettes and U.S. Pat. No. 4,832,421 to Donald I. Shoffuer for Ready-To-Assemble Cabinet are exemplary.

As illustrated in the above cited U.S. Patents, slot-to-slot interconnections are common expedients for quickly connecting shelving to a support member, or interconnecting other types of planar objects. The difficulty encountered when this type of connection is employed on a load-bearing shelf, for example, is that the slotted portion of the shelf that embraces the sides of the vertical support member is itself without support. Consequently, when the shelf is loaded with books or other heavy objects the portion of the shelf that is proximate the unsupported sides of a slot tends to droop and bend.

Another difficulty with shelving of the type referred to is the typical predominance of rectangular elements and an absence of triangular elements within the structure that are necessary to create rigidity and stability.

Accordingly, it is an object of the present invention to provide a slot-to-slot interconnecting shelving assembly that contains one or more triangular bracing elements that are themselves interconnected to the horizontal shelving units and the vertical support units by means of slot type connections.

Another object of the invention is to provide a general use slot-to-slot interconnection that will exhibit structural support for a load-bearing member along the entire length of a slot formed in that member.

Other objects, features and advantages of the invention will become apparent upon a reading of the following description of a preferred form of the invention, taken together with the accompanying drawings.

DETAILED DESCRIPTION

Figure 1:
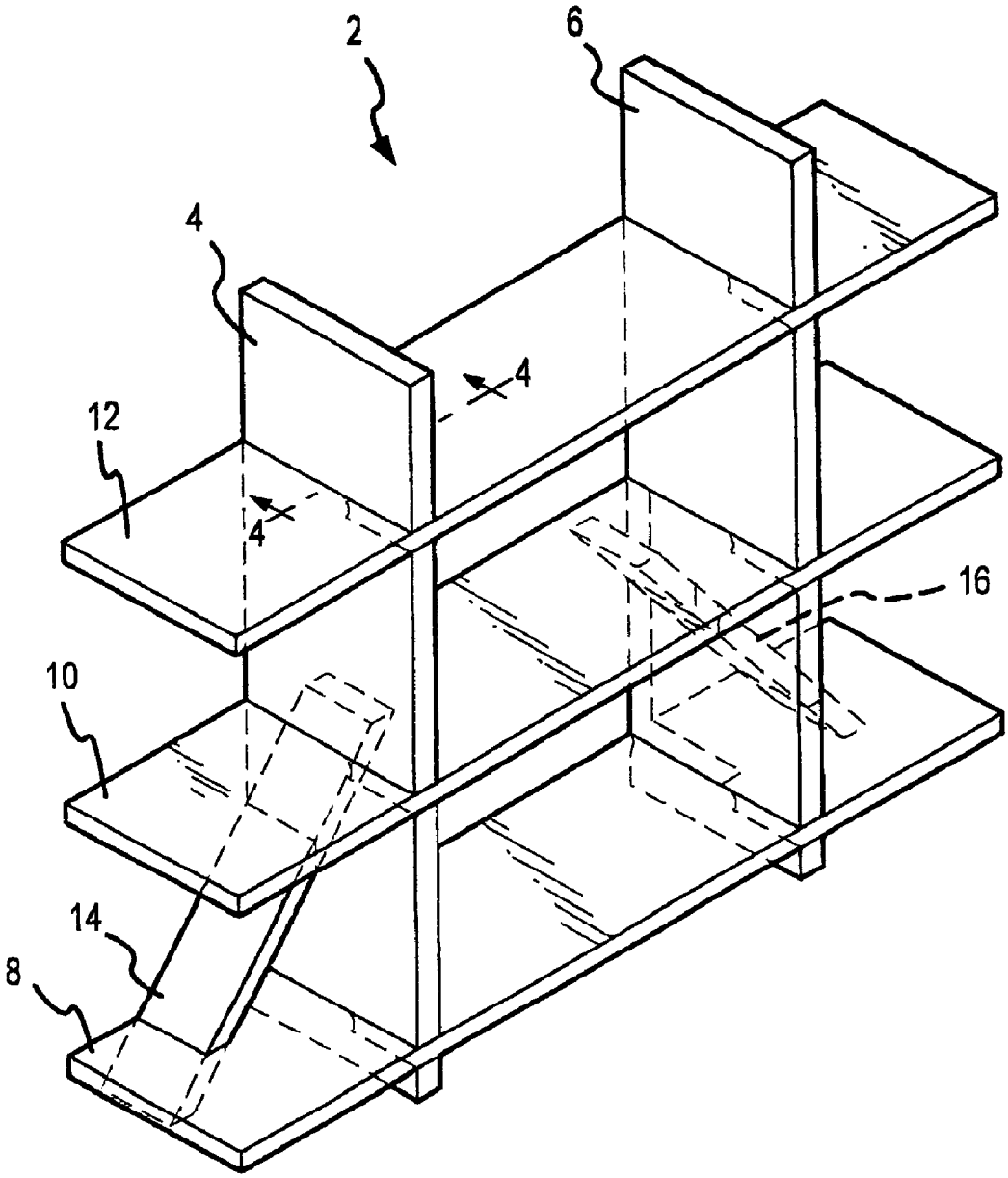
FIG. 1 is a perspective view of a shelving unit assembled with elements of the present invention.
Figure 3:
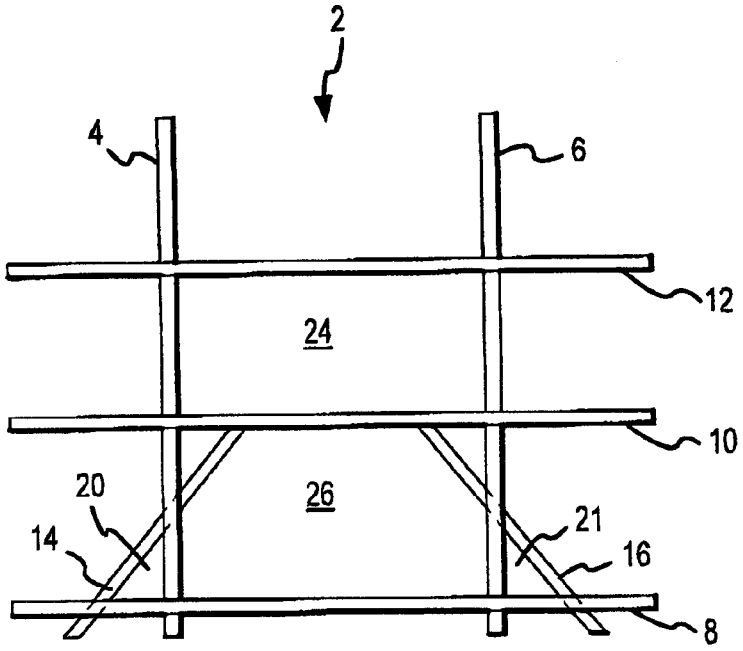
FIG. 3 is a side elevational view of the shelving of FIG. 1.

An assembled shelving unit, or bookcase, 2 is shown in FIG. 1. The unit comprises a pair of spaced apart vertical support members 4 and 6 that carry horizontally disposed planar shelves 8, 10 and 12. To add rigidity to the structure, diagonal braces 14 and 16 extend from the surface on which the bookcase rests through a base shelf 8, through the lower portion of the vertical support members 4 and 6 and into contact with the undersurface of the second shelf 10, as also shown in FIG. 3. The contacts made by the braces with the base shelf and the vertical support members produce two triangular structural elements 20 and 21 within the shelving unit 2, thus providing the structural rigidity that would not otherwise be present with only the rectangular spaces 24 and 26 formed by the elements of the shelving unit.

Figure 2:
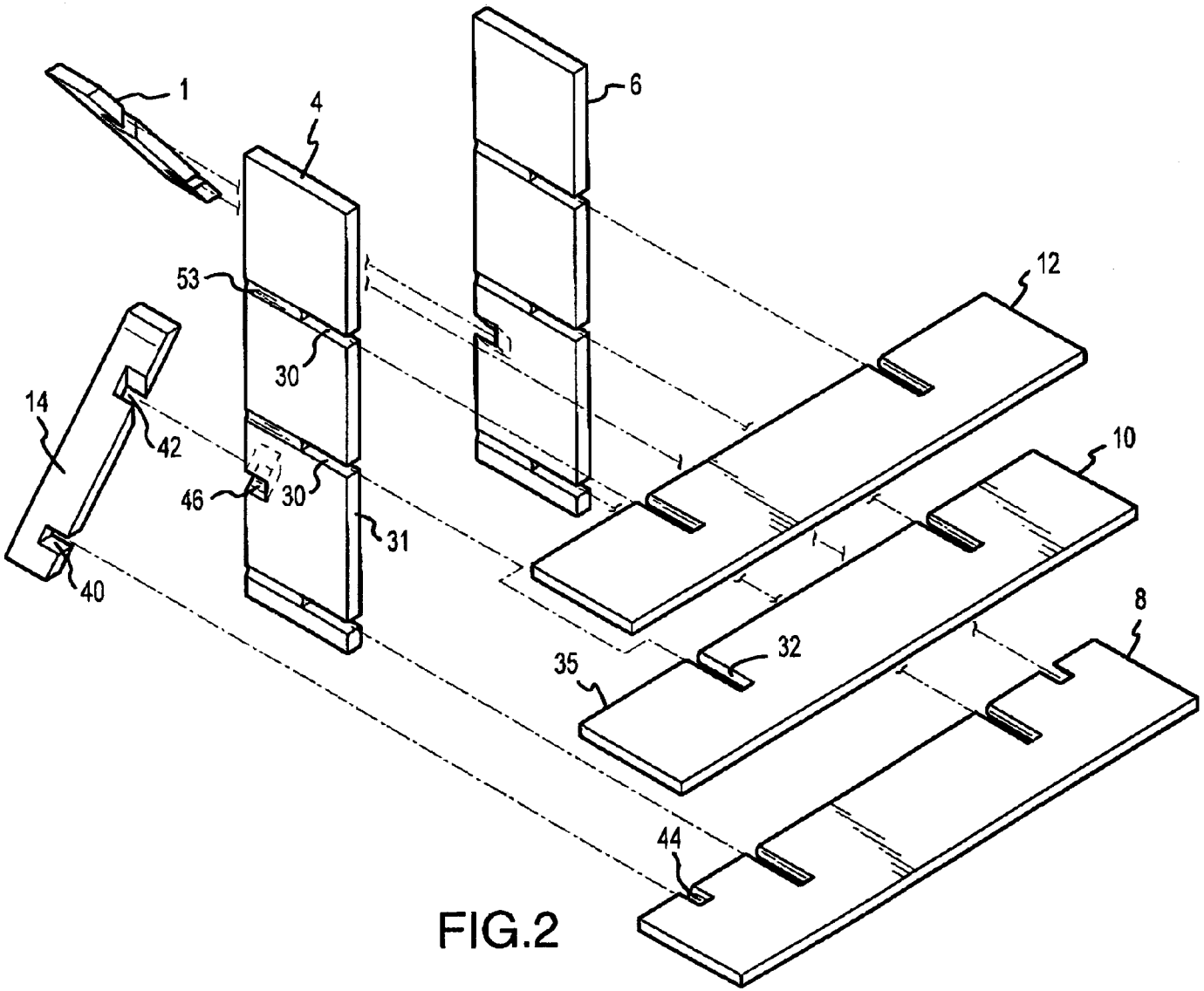
FIG. 2 is an exploded perspective view of the shelving shown in FIG. 1.

Referring to FIG. 2, it is seen that the shelves 8, 10 and 12 are attached to the vertical support members 4 and 6 through the use of interlocking and cooperating slots that are formed in the shelves and the vertical support members. For example, an elongated slot 30 that extends rearwardly from the front edge 31 of the vertical support member 4 mates and interlocks with a similarly formed slot 32 that extends from the rear edge 35 of the shelf 10. The other slots in the shelves and support members function in the same manner. When fully engaged and interlocked, the shelves 8, 10 and 12 assume a relationship, with respect to the vertical support members 4 and 6, that is shown in FIG. 1.

Using the vertical support members and the horizontal shelves as the only elements of the structural whole, a plurality of rectangular shapes, or spaces, 24 and 26 are created. It is well known that such shapes do not provide structural rigidity. One or more triangular shapes within the structure will provide resistance to bending or other distortion of the structure. To achieve this result a pair of braces 14 and 16 are provided to form structural triangles 20 and 21. Each of the braces contain angularly disposed slots 40 and 42 that engage and interlock with angularly disposed slots 44 and 46 in the base shelf 8 and the lower portion of vertical support member 4 respectively. The brace members 14 and 16 engage the rear, or backside, portion of the shelving unit. For units with more shelves than the one illustrated in the drawings, additional braces can be employed.

Figure 4:
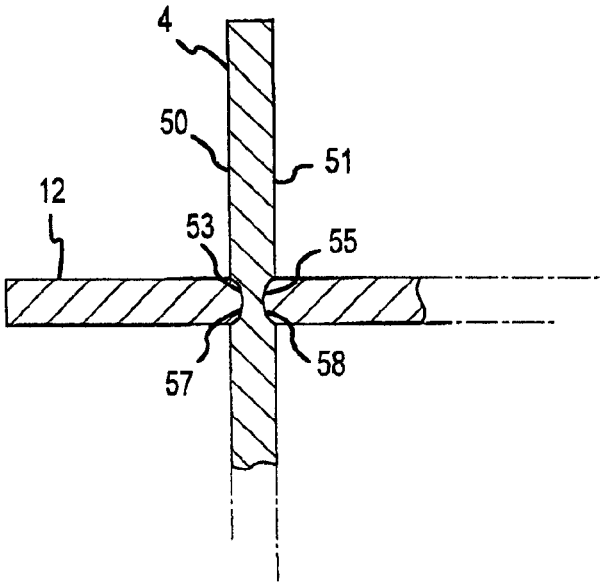
FIG. 4 is a cross sectional view taken along lines 4—4 of FIG. 1.
Figure 5:
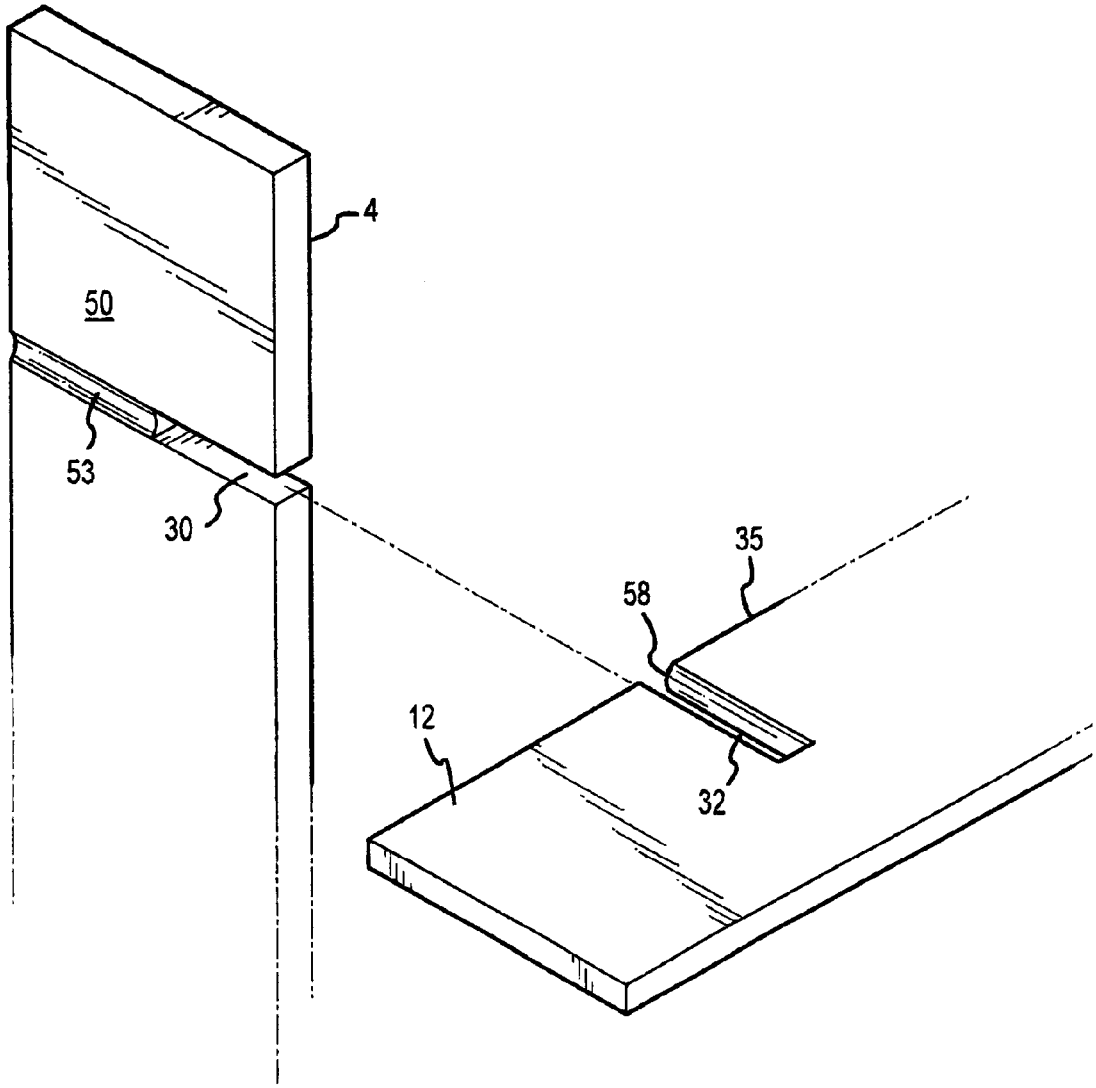
FIG. 5 is an enlarged perspective view of the slot-to slot connection between a vertical support member and a horizontal shelf member showing in detail the treatment of the respective parts that creates support for the normally unsupported sides of the slot that embrace the rearward side portions of the vertical support member.

In cases where the shelves are wide and the shelving material has some flexibility, a load on the shelves, such as heavy books, will cause the shelf edge 35 to droop because there is no support for the shelf rearward of the closed end of the slot 32. To obviate this problem, the respective shelf and support slots are provided with a cooperating concave recess and a convex boss. Referring to FIGS. 4 and 5, as exemplary of all of the slot-to-slot connections in the shelving structure, the surfaces 50 and 51 on both sides of the vertical support member 4 are relieved to form a concave recesses 53 and 55. These recesses 53 and 55 extend from the terminal end of the slot 30 in the support member rearwardly toward the back edge 56 of the vertical support member 4. To structurally cooperate with the concave recesses, each of the parallel sides of the shelf slot 32 is provided with a convex boss 57 and 58. In the preferred form of the invention the bosses and recesses are similarly curved or circular so as to fit snuggly together, as shown in FIG. 4. This construction provides support for that portion of the shelf that is rearward of the terminal end of the slot 32 and prevents the shelf from sagging or bending under a load.

I claim:

1. A shelving assembly, comprising, at least one horizontally disposed shelf member having front and rear edges and having an elongated transverse shelf slot extending from the rear edge thereof, said elongated transverse shelf slot having parallel sides, at least one brace-receiving slot having parallel sides and disposed in the rear edge of the shelf member, where the sides of the brace-receiving slot are not perpendicular to the planar surface of the base shelf, a vertically disposed support member having at least two opposing planar surfaces and front and rear edges and having a transverse support slot extending from the front edge thereof with parallel sides and a terminal end, at least one brace-receiving slot in the rear edge of said support member, said slot having sides that are not perpendicular to the planar surfaces of the support member, and at least one brace member having ends that are respectively disposed in the brace-receiving slot of the shelf member and the support member.

2. A shelving assembly, comprising, at least one horizontally disposed shelf member having front and rear edges and having an elongated transverse shelf slot extending from the rear edge thereof, said elongated transverse shelf slot having parallel sides, at least one of which is contoured, at least one brace-receiving slot having parallel sides and disposed in the rear edge of the shelf member, where the sides of the brace-receiving slot are not perpendicular to the planar surface of the base shelf, a vertically disposed support member having at least two opposing planar surfaces and front and rear edges and having a transverse support slot extending from the front edge thereof with parallel sides and a terminal end, said support member also having a contoured recess in at least one of said surfaces that extends from the terminal end of the transverse support slot toward the rear edge of the support member, where the contour of the recess corresponds to the contour of the side of the elongated transverse shelf slot, at least one brace-receiving slot in the rear edge of said support member, said slot having sides that are not perpendicular to the planar surfaces of the support members, and at least one brace member having ends that are respectively disposed in the brace-receiving slot of the shelf member and the support member.

3. An assembly of shelving units that are interconnected without fasteners to form a free standing piece of furniture, comprising, a base shelf having a planar upper surface, first and second ends and front and rear edges, at least one additional shelf having a planar upper surface, first and second ends and front and rear edges, a first plurality of spaced apart elongated mutually parallel slots disposed transversely in the rear edge of each of said shelves intermediate the first and second ends thereof, each having parallel sides and a lengthwise axis, at least one brace-receiving slot having parallel sides and disposed in the rear edge of the base shelf, where the sides of the brace-receiving slot are not perpendicular to the planar surface of the base shelf, a first plurality of support members having parallel planar surfaces and each having front and rear edges, a plurality of elongated mutually parallel slots disposed in the front edge of each of said support members, whereby the slots in the support members are sized and adapted for interlocking engagement with corresponding slots in the shelves, at least one brace-receiving slot in the rear edge of each of said support members, said slot having sides that are not perpendicular to the planar surfaces of the support members, and at least one brace member having ends that are respectively disposed in the brace-receiving slot of the base shelf and one of the support members.

4. The assembly of claim 3 where the lengthwise axes of the slots disposed transversely in the rear edge of each of said shelves are perpendicular to the rear edge thereof.

5. The assembly of claim 3 where at least one of the support members includes at least one pair of spaced apart, parallel, and elongated surface recesses that are substantially aligned with one of said slots in the support member.

6. The assembly of claim 5 where the contour of the sides of the shelf slot that is adapted to interconnect with the slot in the support member that is aligned with the said pair of surface recesses is shaped to match the contour of the recess.

7. The assembly of claim 6, where the contour of each of the recesses is curved.

8. The assembly of claim 3 where the brace member extends through the brace-receiving slot in the support member to engage the at least one additional shelf.

* * * * *